US006036127A

United States Patent [19]

Möller

[11] Patent Number: 6,036,127

[45] Date of Patent: Mar. 14, 2000

[54] MILL LINING ELEMENTS

[75] Inventor: Tage Möller, Skellefteå, Sweden

[73] Assignee: Svedala Skega AB, Sweden

[21] Appl. No.: 08/953,520

[22] Filed: Oct. 17, 1997

[51] Int. Cl.[7] ..... B02L 17/22

[52] U.S. Cl. ..... 241/183; 241/299; 241/DIG. 30

[58] Field of Search ..... 241/182, 183, 241/199, 299, DIG. 30

[56] References Cited

U.S. PATENT DOCUMENTS

| | | | |
|---|---|---|---|
| 4,424,938 | 1/1984 | Day | 241/DIG. 30 |
| 4,583,575 | 4/1986 | Lundmark | 241/183 |
| 4,848,681 | 7/1989 | Eriksson et al. . | |
| 5,752,665 | 5/1998 | Wason | 241/183 |

FOREIGN PATENT DOCUMENTS

| | | | |
|---|---|---|---|
| 1304872 | 4/1987 | U.S.S.R. | 241/183 |

*Primary Examiner*—Mark Rosenbaum

*Attorney, Agent, or Firm*—Renner, Otto, Boisselle & Sklar

[57] ABSTRACT

A lining element (10) for mounting onto an inner surface of a drum mantle (56) in a grinding mill, comprising an elongated lifter member (12) of a wear resistant material adapted to be axially oriented with respect to the drum mantle and to project radially into the drum, and an elongated single-piece support member (26) of an elastomeric material adapted to resiliently support the elongated lifter member over a full length thereof above the inner surface of the drum mantle. The support member is extended peripherally in a rearward direction with respect to an operational forward direction of rotation of the drum into contact with a subsequent lining element (10) to be mounted onto the inner surface, and to cover entirely therebetween the inner surface of the drum mantle.

11 Claims, 2 Drawing Sheets

MILL LINING ELEMENTS

BACKGROUND OF THE INVENTION

The present invention relates to lining elements for mounting onto an inner surface of a drum mantle in a grinding mill. More specifically, the invention relates to lining elements having an axially oriented elongated wear resistant lifter member projecting radially into the drum, and a resilient support member for the lifter member.

In a lining element of this type, disclosed for example in U.S. Pat. No. 4,848,681, Eriksson et al, the lifter member made of a hard metal alloy or a ceramic material is effective as a wear resistant component of the mill lining whereas the support member made of a resilient elastomeric material is effective as an impact absorbing component protecting the wear resistant lifter member from breaking. By combining the wear-resistant and impact absorbing materials in this known way, the lifter element will be more resistant to failure and have a longer service life, as compared, for example, with mill linings entirely made of steel.

SUMMARY OF THE INVENTION

An object of the present invention is to further improve a lining element of this kind as to resistance to wear and breaking as well as to improve ease and safety of installation.

The invention provides a lining element for mounting onto an inner surface of a drum mantle in a grinding mill, comprising an elongated lifter member of a wear resistant material adapted to be axially oriented with respect to the drum mantle and to project radially into the drum, and an elongated single-piece support member of an elastomeric material adapted to resiliently support the elongated lifter member over a full length thereof above the inner surface of the drum mantle, said support member being extended peripherally in a rearward direction with respect to an operational forward direction of rotation of the drum to contact a subsequent lining element to be mounted onto said inner surface, and to cover therebetween the inner surface of the drum mantle.

The invention also provides a mill lining comprising a plurality of lining elements for mounting onto an inner surface of a drum mantle in a grinding mill to cover said inner surface, each lining element comprising an elongated lifter member of a wear resistant material adapted to be axially oriented with respect to the drum mantle and to project radially into the drum, and an elongated single-piece support member of an elastomeric material adapted to resiliently support the elongated lifter member over a full length thereof above the inner surface of the drum mantle, said support member being extended peripherally to contact a subsequent of said lining elements in a rearward direction with regard to an operational direction of rotation of the drum mantle, and to cover entirely therebetween the inner surface of the drum mantle.

In a mill lining according to the invention, the support member also serves as a wear plate entirely covering the drum mantle rearwardly of the lifter member to the following lining element in the drum. Thereby also the full volume of the single-piece elastomeric element will effectively participate in resiliently supporting the lifter member against the impact forces from grinding charge striking the leading face of the lifter member during operation of the mill. The peripherally wide support member also presents a large base for safely securing the lining element to the drum mantle to better withstand bending moments imposed on the support member. Due to fewer components, this single-piece lifter-wear plate element is also mounted or replaced in shorter time as compared to known composite material mill linings.

BRIEF DESCRIPTION OF THE DRAWINGS

Preferred embodiments of the invention will be described in greater detail in the following description with reference to the appended drawing in which.

DETAILED DESCRIPTION

Figure 1:
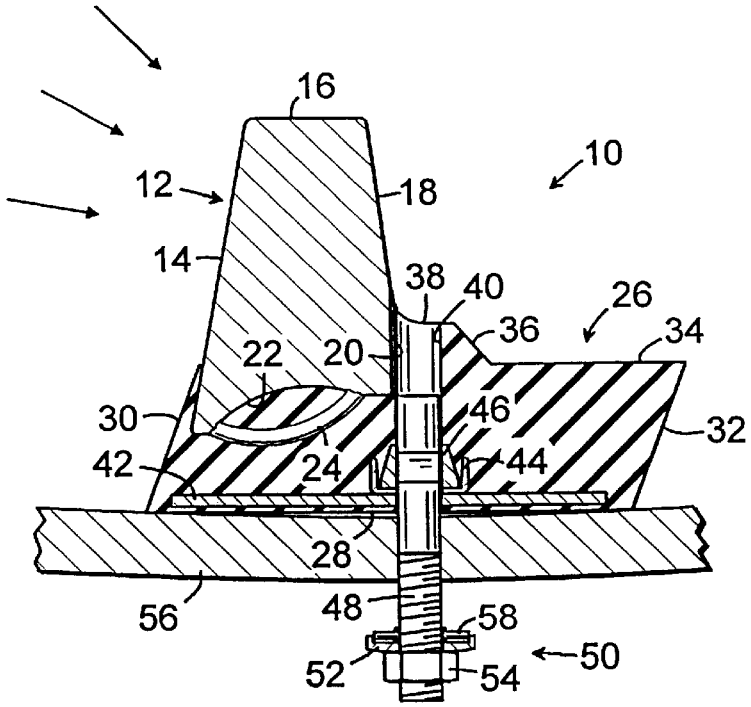
FIG. 1 is a cross sectional view of a first embodiment of a lining element according to the invention, prior to mounting onto the inner surface of a mill drum.

In both embodiments of the invention, the respective lining elements 10 and 11 are elongated lining elements adapted to completely cover the inner mantle surface of a drum 56 in a grinding mill (not shown) for grinding materials such as metal ore, by tiling the elements peripherally and lengthwise onto the mantle surface.

Each lining element is comprised of a bottom support member 26/27 made of polymeric material, such as rubber, and a top lifter member 12/13 made of a hard wear resistant metal alloy, such as hi-chrome white iron or steel, but ceramic materials, such as alumina oxide, are also possible. The support member 26 extends peripherally in a rearward direction as a wear plate having a flat top surface 34 into contact with a support member 26 of the subsequent lining element 10 in the drum mantle 56. In the forward direction, the flat surface 34 is continued in an upward sloping surface 36 adding the back-up volume of the support member. The sloping surface 36 is in turn continued by still another upward sloping curved surface 38 adjoining the lifter portion of the lining element. In the FIG. 1 embodiment, the lifter portion is exclusively comprised of the hard wear resistant member 12 having bottom, leading, top, and trailing faces 22, 14, 16, and 18, respectively. In this embodiment, the drum 56 can optionally also be rotated in the opposite rearward direction during operation, for example, in order to extend the service life of transmission components and the lining itself. In the FIG. 2 embodiment, the hard wear resistant member having respective bottom, leading, top, and rear faces 23, 15, 17, and 19, is rearwardly supported by a lifter back portion of the support member 27, which accordingly has a top face 41, as well as a lifter trailing face 39.

The lifter member 12/13 and support member 26/27 are integrally joined by molding and vulcanizing the polymer material to intimately adhere to the respective surfaces of the lifter member in a manner well-known in the rubber industry.

Figure 2:
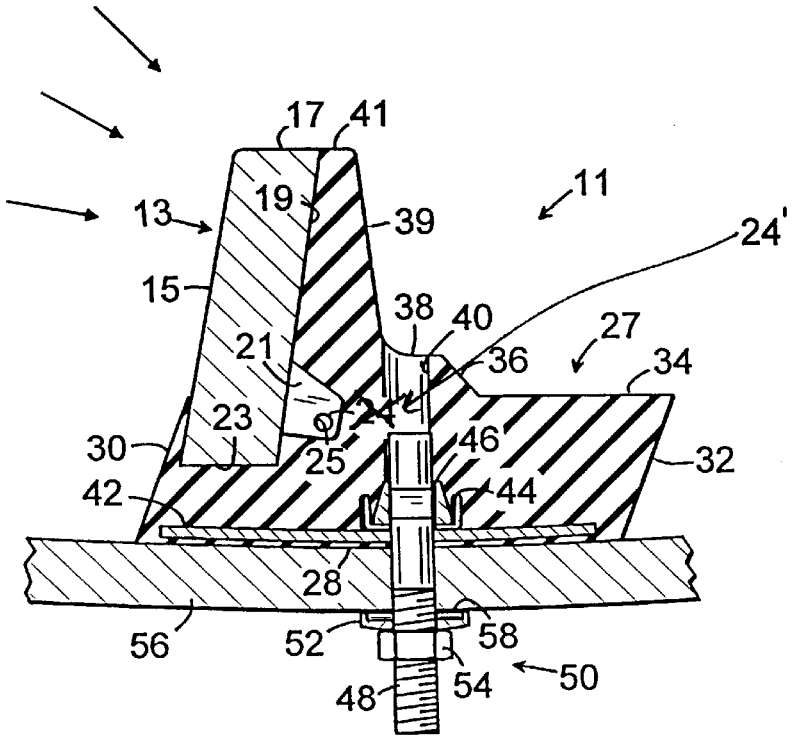
FIG. 2 is a cross sectional view of a second embodiment of a lining element according to the invention, mounted onto the inner surface of a mill drum.

In addition to the vulcanized bond, the lifter member 12/13 is also secured for safety by a mechanical bond to the support member by securing elements embedded in the polymer material. In the embodiment of FIG. 1, the securing elements are a plurality (only one is visible) of arc-shaped protrusions 24 integral with the lifter member 12 and extending downwards into the polymer material from the concavely profiled bottom surface of the lifter member 12, to form closed loops in the elastomeric material molded thereon. In the embodiment of FIG. 2, the securing elements are a plurality (only one is visible) of brackets 21 likewise integral with the lifter member 15 and extending rearwardly into the polymer material from the flat rear surface 19 of the lifter member 13. To complete the mechanical bond in this embodiment, a metal pin 24' extending substantially over the full length of the lining element is inserted through corresponding holes 25 in the brackets 21 prior to forming the elastomeric material by molding the support member 27 onto the wear resistant lifter member 15.

As will be seen from the drawing, the wear resistant lifter member of each embodiment is effectively backed-up by the massive resilient support member against impact forces resulting from grinding media striking the lifter member from the various most likely directions as approximately indicated by the arrows in FIGS. 1 and 2 during operation of the mill when the drum mantle 56 rotates in a clock-wise direction. Compared to known mill linings where the lifter elements, although made of composite wear resistant and resilient materials, are each separately mounted between separate bottom lining elements in the form of wear plates, the integral mill lining elements according to the invention will better withstand the impact forces from the mill charge.

Each lining element is mounted to the drum mantle 56 by a plurality of bolt arrangements 50 located near the center between the sloping front and rear surfaces 30, 32 of the support member and distributed evenly along the length of the lining element.

The bolt arrangements 50 each include a threaded bolt 52 received in a through-bore 40 opening in the curved top surface 38 and in the bottom surface 28 of the support member. Adjacent and parallel to the bottom surface 28 of the support member, a plate 42 of rolled steel having elastic properties is embedded in the polymer material in order to distribute the clamping force from the bolt arrangements 50 evenly over the bottom portion of the support member when the lining element is mounted to the drum mantle 56 as shown in the FIG. 2 embodiment. The conical inner portion of each bolt 52 is engaged into a bolt head locking device 46 embedded in the polymer material around the through-bore 40 above the steel plate 42, and a U-shaped steel beam 44 located between steel plate 42 and locking device 46 distributes the clamping forces from the bolt arrangements 50 evenly along the length of the lifter element in the mounted state thereof. Each bolt arrangement 50 is completed at the outer surface of the drum mantle 56 by the engagement of the treaded radially outer portion of bolt 52 with a nut 54, sealer 58 and a washer 48.

As is apparent from FIG. 1, the steel plate 42 and the bottom surface 28 of the support member are planar in the unclamped state of the lining element. When the bolt arrangements 50 are tightened to a clamped mounted state as shown in FIG. 2, the steel plate 42 will be deflected and stressed to distribute the clamping force effectively also over the full peripheral width of the support member, thereby minimizing the likelihood of the peripheral end portions of the support member lifting from the surface of drum mantle 56. In the unbiased state prior to mounting, the steel plate may advantageously also have a curved cross section (not shown)-concave or convex and with varied curvature depending on desired clamping characteristics.

Figure 3:
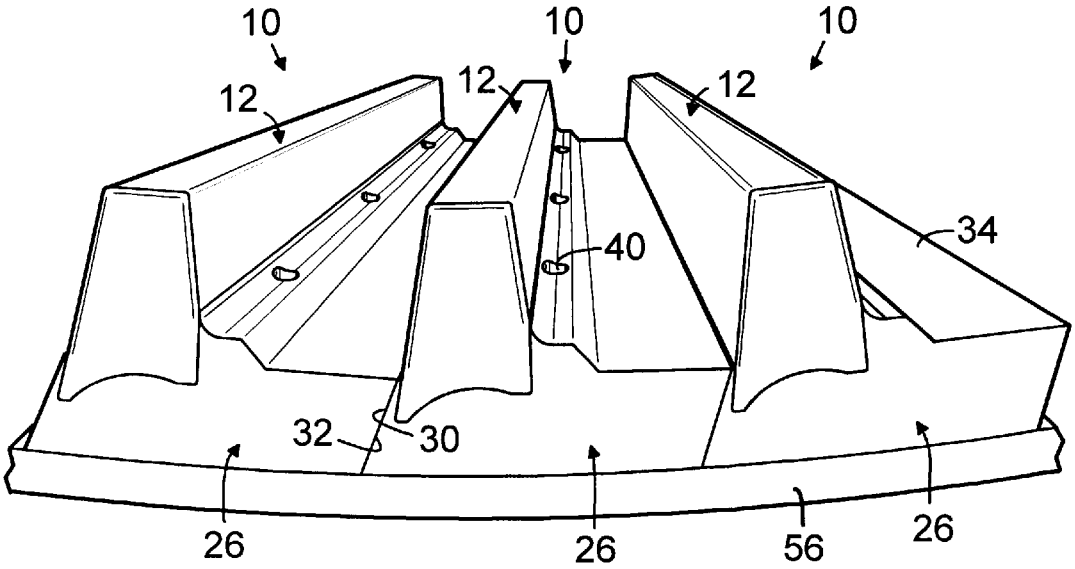
FIG. 3 is a partial perspective view of three lining elements according to FIG. 1, mounted onto the inner surface of a mill drum.

As during mill operation, the trailing end of an isolated support member may be less inclined to lift from drum mantle 56 than the leading end, the backward-upward sloping wedge interface (FIG. 3) between adjoining rear and front peripheral end surfaces 32, 30 is also effective to distribute the clamping force through interfaces to prevent the more inclined front end of each support member to lift from drum mantle due to impact forces from mill charge striking the leading face of lifter member by firmly wedging the front end onto the surface of the drum mantle 56.

In operation, the impact forces resulting from the mill charge striking the wear resistant lifter members of the lining elements inside the drum mantle 56 will be effectively endured by the backing support members 26, 27 which serve not only on efficiently resiliently dampen the shocks imposed to the lifter members and thereby protect them from breaking but also to lengthen the life of the lining elements by distributing the impact evenly over a large backing volume of rubber polymer material of unbroken integrity. Compared with known composite linings, full steel linings or full rubber linings, the single piece lifter-wear plate element according to the invention also has an improved lifespan and, resulting from fewer and larger components, drastically shortens the time and cost for the relining of a mill.

I claim:

1. A single-piece lining element for mounting onto an inner surface of a drum mantle in a grinding mill, comprising an elongated lifter member of a wear resistant material adapted to be axially oriented with respect to the drum mantle and to project radially into the drum, and an elongated single-piece support member of an elastomeric material adapted to resiliently support the elongated lifter member over a full length thereof above the inner surface of the drum mantle, the lifter and support members being integrally bonded together to form said single-piece lining element, said support member being extended peripherally in a rearward direction with respect to an operational forward direction of rotation of the drum to contact a subsequent lining element to be mounted onto said inner surface, and to cover entirely therebetween the inner surface of the drum mantle, said wear resistant material being different from said elastomeric material.

2. A lining element as defined in claim 1, including clamping means comprising bolts arranged substantially centrally in a peripheral direction of the support member in the drum mantle and spaced over the length of the support member.

3. A lining element as defined in claim 2, wherein said clamping means comprises a steel plate in the elastomeric material of the support member, and wherein said plurality of bolts extend through the steel plate and the support member for clamping the steel plate and the support member to said inner surface.

4. A lining element as defined in claim 3, wherein said steel plate is adapted to be elastically deflected for distributing clamping force peripherally over said inner surface when being clamped together with the support member to said inner surface.

5. A lining element as defined in claim 3, further including a U-shaped beam member embedded in the elastomeric material of the support member above said steel plate and extending over a full length of the support member, and a plurality of bolt head locking devices located above and spaced along the U-shaped beam for engagement with a respective of said bolts for clamping the steel plate and the support member to said inner surface.

6. A lining element as defined in claim 1, wherein peripherally opposite ends of the support member are made sloping so as to wedge a front end of a subsequent support member onto said inner surface by engagement of the rear end of a preceding support member.

7. A lining element as defined in claim 1, wherein said lifter member is exposed only in a forward direction face of the lining element and supported in the rearward direction by the support member.

8. A lining element as defined in claim 1, wherein said lifter member is exposed both in a forward and a rearward direction face of the lining member.

9. A single-piece lining element for mounting onto an inner surface of a drum mantle in a grinding mill, comprising an elongated lifter member of a wear resistant material adapted to be axially oriented with respect to the drum mantle and to project radially into the drum, and an elongated single-piece support member of an elastomeric material adapted to resiliently support the elongated lifter member over a full length thereof above the inner surface of the drum mantle, the lifter and support members being integrally bonded together to form said single-piece lining element, said support member being extended peripherally in a rearward direction with respect to an operational forward direction of rotation of the drum to contact a subsequent lining element to be mounted onto said inner surface, and to cover entirely therebetween the inner surface of the drum mantle and further including securing means mechanically securing the lifter member to the support member, said securing means comprising a plurality of arc-shaped brackets projecting from a bottom face of the lifter member, each bracket forming a closed loop in the elastomeric material of the support member.

10. A single-piece lining element for mounting onto an inner surface of a drum mantle in a grinding mill, comprising an elongated lifter member of a wear resistant material adapted to be axially oriented with respect to the drum mantle and to project radially into the drum, and an elongated single-piece support member of an elastomeric material adapted to resiliently support the elongated lifter member over a full length thereof above the inner surface of the drum mantle, the lifter and support members being integrally bonded together to form said single-piece lining element, said support member being extended peripherally in a rearward direction with respect to an operational forward direction of rotation of the drum to contact a subsequent lining element to be mounted onto said inner surface, and to cover entirely therebetween the inner surface of the drum mantle and further including securing means mechanically securing the lifter member to the support member, said securing means comprising a plurality of brackets projecting from a rear face of the lifter member, said brackets being joined by a pin forming closed loops between adjacent pairs of brackets in the elastomeric material of the support member.

11. A mill lining comprising a plurality of single-piece lining elements for mounting onto an inner surface of a drum mantle in a grinding mill to cover said inner surface, each lining element comprising an elongated lifter member of a wear resistant material adapted to be axially oriented with respect to the drum mantle and to project radially into the drum, and an elongated single-piece support member of an elastomeric material adapted to resiliently support the elongated lifter member over a full length thereof above the inner surface of the drum mantle, the lifter and support members being integrally bonded together to form said single-piece lining elements, said support member being extended peripherally to contact a subsequent of said lining elements in a rearward direction with regard to an operational direction of rotation of the drum mantle, and to cover entirely therebetween the inner surface of the drum mantle, said wear resistant material being different from said elastomeric material.

* * * * *